US007578050B2

(12) United States Patent
Matsuoka et al.

(10) Patent No.: US 7,578,050 B2
(45) Date of Patent: Aug. 25, 2009

(54) SWITCH AND METHOD OF MANUFACTURING THE SAME

(75) Inventors: Kuniharu Matsuoka, Fukui (JP); Masahiro Yamaguchi, Fukui (JP); Keiichirou Tamenaga, Fukui (JP); Kazuyuki Watanabe, Fukui (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 11/907,013

(22) Filed: Oct. 9, 2007

(65) Prior Publication Data

US 2008/0110736 A1 May 15, 2008

(30) Foreign Application Priority Data

Nov. 13, 2006 (JP) ..... 2006-306338

(51) Int. Cl.
*H01H 9/00* (2006.01)

(52) U.S. Cl. ..... 29/622; 200/314

(58) Field of Classification Search ..... 200/314
See application file for complete search history.

(56) References Cited

U.S. PATENT DOCUMENTS 6,380,497 B1 * 4/2002 Hashimoto et al. ..... 200/5 A
6,960,733 B2 * 11/2005 Hanahara et al. ..... 200/314
7,129,432 B2 * 10/2006 Fujii et al. ..... 200/314
7,135,650 B2 * 11/2006 Jung ..... 200/314
7,244,898 B2 * 7/2007 Kim ..... 200/314
7,512,299 B2 3/2009 Kaneko
7,518,087 B2 * 4/2009 Koga et al. ..... 219/121.73

FOREIGN PATENT DOCUMENTS

CN 1692461 A 11/2005
JP 2005-317236 11/2005
WO WO 99/19893 A1 4/1999

OTHER PUBLICATIONS

Chinese Office Action issued in Chinese Patent Application No. CN 200710181934X dated Mar. 6, 2009.

* cited by examiner

*Primary Examiner*—Renee S Luebke
*Assistant Examiner*—Lheiren Mae A Anglo
(74) *Attorney, Agent, or Firm*—McDermott Will & Emery LLP

(57) ABSTRACT

A switch to be used mainly for controlling a variety of electronic devices in automobiles, and a method of manufacturing the same switch are disclosed for providing a switch free from positional deviation in its display section and easy to manufacture. Operating units having no display sections are mounted to a housing, then the shapes of each one of the operating units are recognized by a control circuit. An upper jig and a lower jig are moved for a laser beam device to remove a non-translucent section and expose parts of a translucent section, thereby forming the display sections. This structure allows eliminating positional deviation of the display sections and also requiring no visual checks done for confirming the display sections in manufacturing.

4 Claims, 8 Drawing Sheets

SWITCH AND METHOD OF MANUFACTURING THE SAME

FIELD OF THE INVENTION

The present invention relates to a switch to be used for controlling a variety of electronic devices installed in automobiles, and it also relates to a method of manufacturing the same switch.

BACKGROUND OF THE INVENTION

A switch has been installed around a steering wheel of an automobile for controlling electronic devices such as an audio device or an air conditioner with a driver taking the wheel. The switch is called "steering switch" and widely used in recent years, so that the market requires the steering switch easy to operate and free from an operating error. Such a conventional switch as discussed above and the manufacturing method thereof are illustrated in FIG. 9-FIG. 11.

FIG. 9 shows an exploded perspective view of the conventional switch, which includes operating units 1-3 shaped like a box and made of insulating resin, and housing 4 also made of insulating resin. Housing 4 has a plurality of through holes 4A (three holes are shown in FIG. 9), and operating units 1, 2 are put in upper (on the right side in FIG. 9) and middle holes 4A respectively such that each one of operating units 1 and 2 can rock to either side on its center as a fulcrum. Operating unit 3 is put in lower hole 4A (on the left side in FIG. 9) such that it can move up and down.

Each one of operating units 1-3 is formed of a translucent section in light color such as white or milky white, and a non-translucent section in dark color such as black. The non-translucent section covers the surface of the translucent section. On the top face of each one of operating units 1-3, the non-translucent section is removed such that the translucent section is exposed to form display section 1A-3A display a letter, a symbol or a pattern. Display sections 1A-3A show the marks such as "+", "−", "Λ", "V" and "MODE". A light shooting behind the translucent sections will make these marks visible.

Wired board 5 having wiring patterns (not shown) on both faces is disposed under operating units 1-3. On the top face of wired board 5, a plurality of push switches 6 (five push switches are shown in FIG. 9) are mounted with their operating shafts 6A projecting upward, so that switch contacts are formed. A plurality of light emitting elements 7 (three elements are shown in FIG. 9) such as LEDs are mounted also on the top face of wired board 5. Switch 8 is thus formed.

FIG. 10A-FIG. 10C show perspective views illustrating step 1 through step 3 of the manufacturing method of this operating unit 1. Foregoing operating units 1-3 can be manufactured this way: As shown in FIG. 10A, firstly form the translucent section, then cover it with the non translucent section by painting its surface, thereby completing operating unit 1. Then insert operating unit 1 into holder 9A of which exterior is somewhat smaller than the inner circumference of operating unit 1. A plurality of operating units 1 (four units are shown in FIG. 10B) are thus placed on the top face of holding plate 9 as shown in FIG. 10B.

Then a laser beam device (not shown) shoots a laser beam to the plurality of operating units 1 on their top faces sequentially for removing the non-translucent section from the translucent section in order to expose parts of the translucent section, thereby forming display section 1A showing letters, marks, or patterns such as "+" and "−" as shown in FIG. 10C.

In a similar way, display section 2A showing the marks of "Λ", "V" is formed on operating unit 2, and display section 3A showing the letters of "MODE" is formed on operating unit 3. These units are then removed from holding plate 9 and packed in, e.g. bags in a given quantity for storage and transportation purposes.

Operating units 1-3 having the display sections which show different marks as discussed above are put into through holes 4A bored on housing 4 at an upper section (right side in FIG. 9), a middle section, and a lower section (left side in FIG. 9), then wired board 5, to which a plurality of push switches and light emitting elements 7 are mounted, is mounted to housing 4, thereby completing switch 8.

FIG. 11 shows a plan view of a steering wheel incorporating the foregoing conventional switch.

Switch 8 thus structured is mounted to steering wheel 11 at spokes 13 on both sides near to wheel 11. These spokes 13 are located between steering wheel 11 and pad 12 that is placed at the center and containing an airbag. The plurality of push switches 6 and light emitting elements 7 are coupled to electronic circuits of the automobile via the wired pattern of wired board 5, connectors, and lead wires (not shown), so that switch 8 is mounted to the automobile.

The foregoing structure allows the driver to depress with his/her finger, e.g., operating unit 1 on its right side where "+" is marked while the driver keeps taking wheel 11 and extends his/her finger for depressing. Operating unit 1 then rocks on its center as a fulcrum, and the underside of operating unit 1 depresses shaft 6A for electrically switching on/off push switch 6 placed under the right side of operating unit 1.

This instance tells that the center of operating unit 1 is fixed by engaging the recess on the lateral face of operating unit 1 with the protrusion on the lateral face of hole 4A, and depression on operating unit 1 at its either side allows operating unit 1 to rock either side on its center as a fulcrum, so that push switch 6 placed under operating unit 1 is switched on or off. This movement is called rocking motion, and such operation is called rocking operation.

The electronic circuits mounted to the automobile control the devices installed to the automobile in response to electrical switch-on/off of push switches 6. For instance, the audio device mounted in the automobile increases its sound volume.

The rocking operation done to operating unit 1 on the left side, where "−" is marked, allows operation unit 1 to rock to the other side of the rocking operation done on "+" mark, and push switch 6 placed under the left side of operating unit 1 is switched on/off, so that the sound volume of the audio device decreases.

Rocking operation done to operating unit 2, where "Λ""V" are marked, allows controlling a temperature of an air conditioner installed in the automobile. Rocking operation to operating unit 3, where "MODE" is displayed, allows controlling switchover of a mode of a given device mounted in the automobile.

To sum up, switch 8 mounted near steering wheel 11 allows the driver to maneuver operating units 1-3 by using, e.g., only his/her thumb for controlling the devices in the automobile while the driver keeps taking steering wheel 11. This structure thus allows the driver to operate the devices with ease while the driver sits at the wheel.

In the dark environment, e.g. in the night, operation of a given switch (not shown) prompts light emitting elements 7 to emit light and illuminate display sections 1A-3A of operating units 1-3, so that the driver can identify the respective operating units with ease even in the dark environment.

Unexamined Japanese Patent Publication No. 2005-317236 is known as prior art of the present invention.

The conventional switch discussed above; however, has the following problems: A laser beam is shot to the top face of each one of operating units 1-3 for removing the non translucent section in a given shape, thereby forming display sections 1A-3A. In this case, a positional deviation of display sections 1A-3A sometimes occurs due to measurement dispersion in operating units 1-3 or wobble between holders 9A and operating units 1-3.

When operating units 1-3 having different display marks are mounted to housing 4, visual check is needed on respective marks, and inserting them into upper, middle, and lower holes 4A without errors in the order of arrangement. This assembly work thus takes a time, and the switch becomes expensive.

SUMMARY OF THE INVENTION

The present invention address the problems discussed above, and aims to provide a switch free from positional deviation at its display sections and easy to manufacture. The present invention also aims to provide a method of manufacturing the same switch.

The switch of the present invention is formed this way: Mount an operating unit to a housing, then shoot a laser beam onto the top face of the operating unit to remove a non-translucent section covering the surface of a translucent section. Form a display section, where parts of the translucent section are exposed, on the operating unit. Because the display section is formed on the operating unit after the switch is assembled, the positional deviation of the display section becomes less, and this method needs no visual check on display marks. The switch easy to manufacture is thus obtainable.

The assembled switch is placed on a lower jig, and a camera mounted to an upper jig placed over the switch recognizes a shape of the operating unit of the switch. The recognized shape is sent to a control circuit, which then prompts a laser beam device to shoot a laser beam, thereby forming the display section on the operating unit. The switch is thus completed in a simple manner with less positional deviation of the display section.

The present invention allows the control circuit to drive a driving device so that at least one of the lower jig or the upper jig can move back and forth, left and right, or up and down, or slant. This structure can manufacture the switch having less positional deviation at the display section even if a plurality of the operating units are arranged in various ways.

The present invention thus can provide the switch free from positional deviation at their display sections and easy to manufacture, it can also provide a method of manufacturing the same switch.

DETAILED DESCRIPTION OF PREFERRED EMBODIMENT

An exemplary embodiment of the present invention is demonstrated hereinafter with reference to FIG. 1-FIG. 8. Similar elements to what is discussed in the background of the invention have the same reference marks and the descriptions thereof are simplified here.

Exemplary Embodiment

Figure 1:
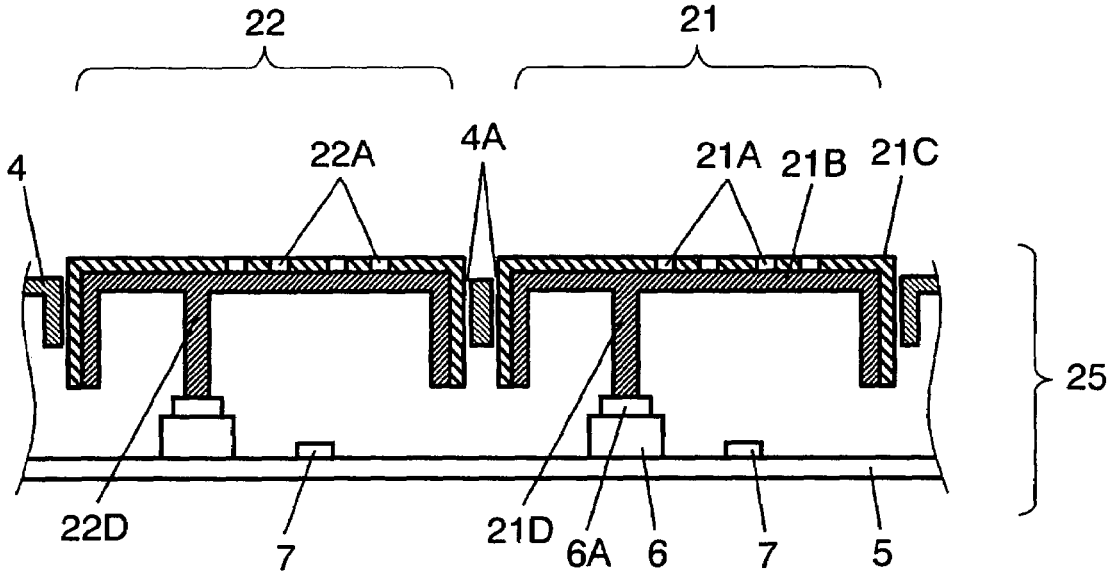
FIG. 1 shows a sectional view of a switch in accordance with an embodiment of the present invention.
Figure 2:
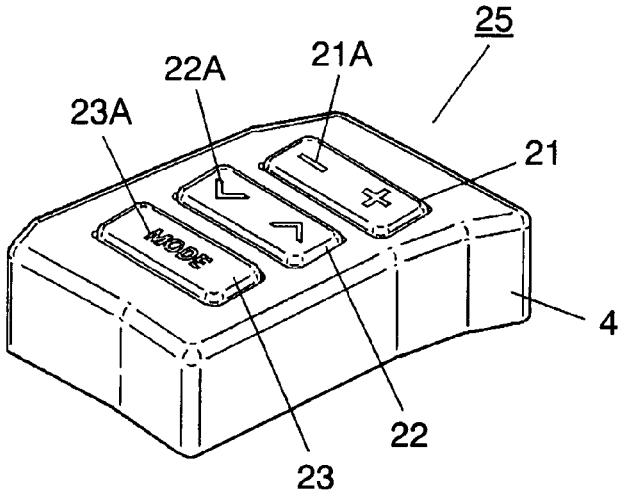
FIG. 2 shows a perspective view of the switch shown in FIG. 1.

FIG. 1 shows a sectional view of a switch in accordance with this embodiment of the present invention, and FIG. 2 shows a perspective view of this switch. As shown in FIGS. 1 and 2, the switch includes operating units 21, 22, 23 shaped like a box and made of insulating resin such as ABS, acrylic, or polycarbonate, and housing 4 made of also insulating resin such as ABS or polyacetal.

Figure 3:
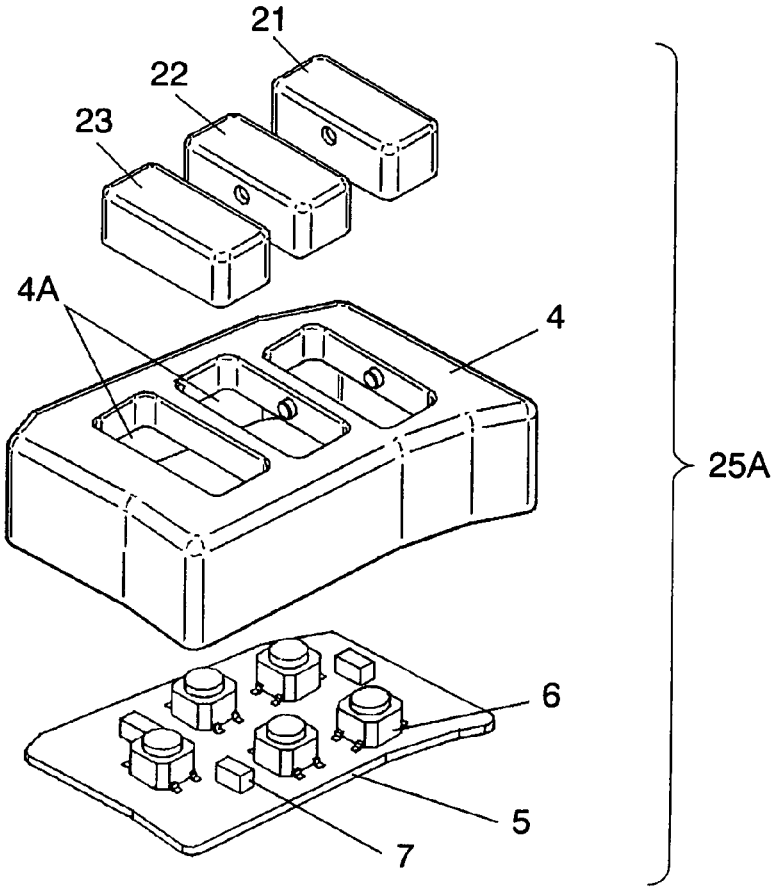
FIG. 3 shows an exploded perspective view of a switch unit before it is assembled into the switch shown in FIG. 1.

A plurality of through holes 4A (three holes are shown in FIG. 3) are formed on the top face of housing 4. Operating units 21, 22 are mounted in upper (right side in FIG. 2) and middle holes 4A such that they rock to either side on the center as a fulcrum. Operating unit 23 is mounted in lower (left side in FIG. 2) hole 4A such that it can move up and down.

Each one of operating units 21, 22, and 23 is formed of translucent section 21B in light color such as white or milky white, and non-translucent section 21C in dark color such as dark. Non-translucent section 21C covers the surface of translucent section 21B. the non-translucent section is removed from the top face of each one of operating units 21-23, such that translucent section 21B is exposed to form display section 21A-23A shaping like a letter, a symbol or a pattern. Display sections 21A-23A show the marks such as "+", "−", "∧""∨" or "MODE".

Wired board 5 made from paper phenol or glass epoxy has wired patterns (not shown) formed of copper foil on both of its faces. On the top face of wired board 5, a plurality of push switches 6 are mounted with their operating shafts 6A projecting upward. This wired board 5 is placed under respective operating units 21-23, so that switch contacts are formed.

Depressing sections 21D, 22D projecting from the underside of operating units 21, 22 touch the upper ends of operating shafts 6A of push switches 6, and wired board 5 placed under the operating units has a plurality of light emitting elements 7 (two elements are shown in FIG. 1), such as light emitting diodes, on its top face. Switch 25 is thus structured.

Figure 4:
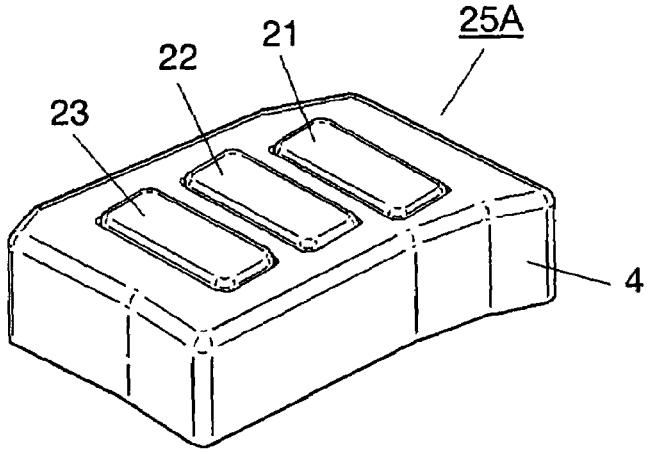
FIG. 4 shows a perspective view of a switch unit before it is completed as the switch shown in FIG. 1.

Next, a method of manufacturing the foregoing switch 25 is demonstrated hereinafter. FIG. 3 shows an exploded perspective view of switch unit 25A before it is assembled into switch 25, and FIG. 4 shows a perspective view of switch unit 25A before it is completed as switch 25.

First, as shown in FIG. 3, operating units 21-23 having no display sections 21A-21C are mounted into upper, middle, and lower holes 4A of housing 4. Upper hole 4A is bored on the right side in FIG. 3, and lower hole 4A is bored on the left side in FIG. 3. Wired board 5 having a plurality of push switches 6 (five switches are shown in FIG. 3) and light emitting elements 7 (three elements are shown in FIG. 3) is mounted to the underside of housing 4. Switch unit 25A is thus assembled, and, as shown in FIG. 4, operating units 21-23 project from the top face of housing 4 of switch unit 25A.

Switch unit 25A thus assembled has no display sections 21A-21C on its operating units 21-23, so that no errors in the order of arrangement are expected when the operating units are mounted to housing 4. Because nothing is marked on the surface of operating units 21, 22 which are supposed to be rocked, so that they are identical to each other and thus no distinction is needed between operating units 21 and 22. Operating units 21 and 22 can be mounted in either upper hole 4A or middle hole 4A, so that an error never happens. Operating units 21, 22 supposed to be rocked thus require no visual check, so that they can be mounted to housing 4 with ease.

Figure 5:
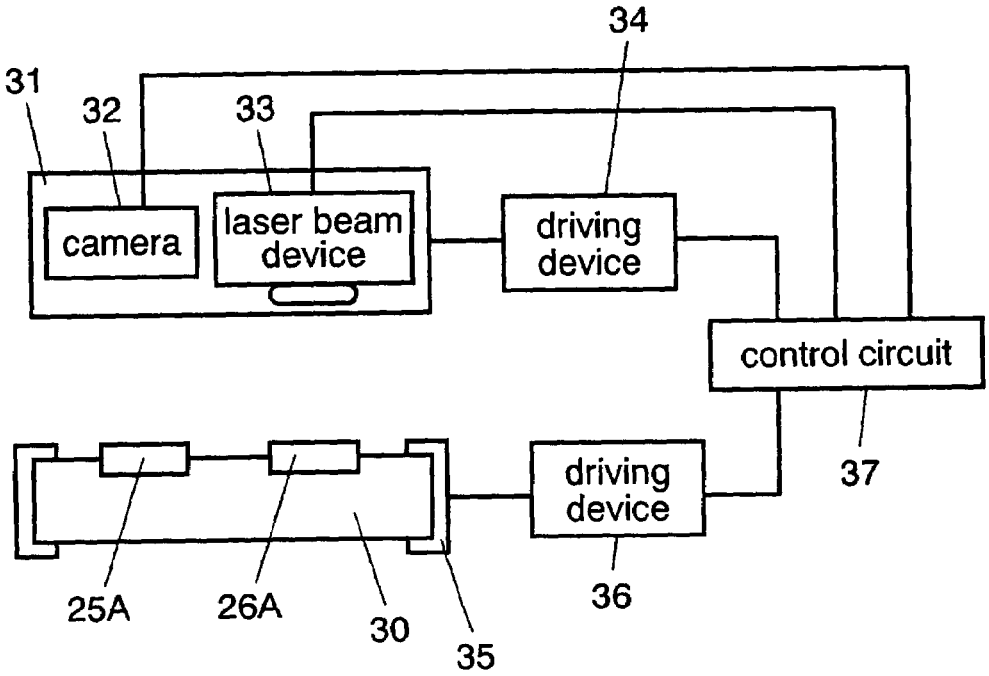
FIG. 5 shows a block diagram of equipment for manufacturing the switch.

FIG. 5 shows a block diagram illustrating equipment to be used for manufacturing the foregoing switch. Switch unit 25A and switch unit 26A in pairs are placed on the top face of lower jig 30 of the manufacturing equipment as shown in FIG. 5. Switch 25 is to be mounted, e.g., on the left side of the steering wheel shown in FIG. 8 and used for controlling a variety of devices mounted to an automobile. Switch 26 is to be mounted, e.g., on the right side of the steering wheel shown in FIG. 8 and used for controlling a variety of devices mounted to the automobile. Switch unit 26A is a semi-fabricated product before it is completed as switch 26.

Since switches 25 and 26 are to be used for controlling a variety of devices mounted to the automobile in different ways, the operating units of switch 25 have different display sections from those of switch 26 in shape.

As shown in FIG. 5, upper jig 31 placed over lower jig 30 includes camera 32 and laser beam device 33, and is coupled to driving device 34 such as a motor for moving upper jig 31 back and forth, left and right, or up and down.

Lower jig 30 is held by chuck 35 which is coupled to driving device 36 such as a motor for moving lower jig 30 back and forth, left and right, or up and down. Camera 32, laser beam device 33, and driving device 34, 36 are coupled to control circuit 37 formed of electronic components such as a microprocessor.

Figure 6A:
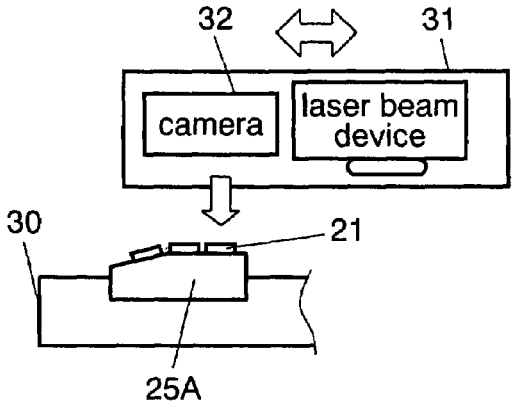
FIG. 6A shows a first step of manufacturing the switch by the equipment shown in FIG. 5.

FIG. 6A-FIG. 6D shows step 1-step 4 in manufacturing the switch with the foregoing equipment. As FIG. 6A shows, control circuit 37 drives driving device 34 for moving upper jig 31 back and forth, left and right, and camera 32 measures the dimensions (width and length) of operating unit 21 of switch unit 25A. The data of outer shape of operating unit 21 is output to control circuit 37, which then calculates, e.g., a reference position such as the center of operating unit 21 based on this data, and stores the result of the calculation.

Figure 6C:
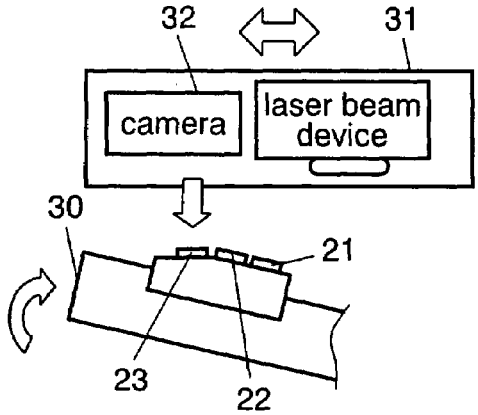
FIG. 6C shows a third step of manufacturing the switch by the equipment shown in FIG. 5.
Figure 6B:
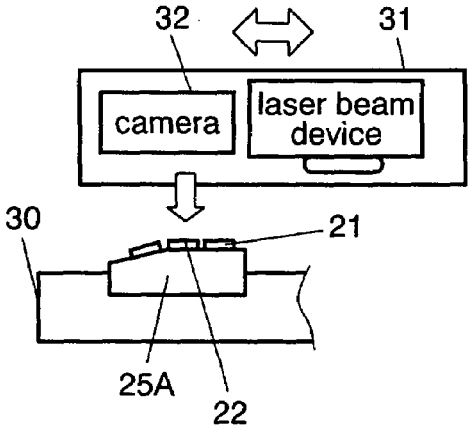
FIG. 6B shows a second step of manufacturing the switch by the equipment shown in FIG. 5.

Next, as shown in FIG. 6B, upper jig 31 is moved left so that camera 32 arrives above upper jig 31, then moved back and forth, left and right for measuring the outer dimensions of operating unit 22. Control circuit 37 calculates a reference position of operating unit 22 based on the data of the dimensions and stores the result.

Then as shown in FIG. 6C, upper jig 31 is moved left so that camera 32 arrives above operating unit 23 for measuring the outer dimensions of operating unit 23. At this time, operating unit 23 is mounted somewhat slantingly with respect to operating units 21 and 22, so that control circuit 37 drives driving device 36 for rotating chuck 35, lower jig 30 is thus slanted and the top face of operating unit 23 becomes horizontal with respect to camera 32. In this status, the outer dimensions are measured, and a reference position is calculated and stored.

Figure 6D:
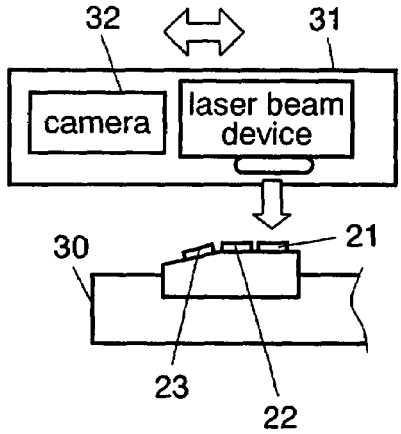
FIG. 6D shows a fourth step of manufacturing the switch by the equipment shown in FIG. 5.

Then as shown in FIG. 6D, lower jig 30 is restored to the horizontal position, and upper jig 31 is moved so that laser beam device 33 arrives above operating unit 31. Upper jig 31 is moved back and forth, left and right with laser beam device 33 shooting a laser beam, so that non-translucent section 21C is removed from the top face of operating unit 21 and parts of translucent section 21B are exposed. Display section 21A is thus formed.

At this time, the outer dimensions measured with camera 32 are compared with the reference outer dimensions by control circuit 37, which reference dimensions of operating unit 21 have been stored in advance. The position of operating unit 21 is thus corrected through moving upper jig 31 back and forth, left and right with reference to the reference position, such as the center, calculated by control circuit 37. The laser beam is shot to the top face of operating unit 21 while the position of operating unit 21 is corrected, thereby forming display section 21A.

Afterward, similar to the measuring of the outer dimensions of operating sections 22 and 23 with camera 32, control circuit 37 drives driving devices 34 and 36 for moving or slanting upper and lower jigs 31 and 30 so that laser beam device 33 can shoot a laser beam for removing the non-translucent section, thereby forming display sections 22A and 23A on the top faces of operating units 22 and 23.

At this time, similar to the formation of display section 21A on the top face of operating unit 21, the outer dimensions measured with camera 32 are compared with the reference outer dimensions by control circuit 37, which reference dimensions of operating units 22 and 23 have been stored in advance. The position of operating units 22 and 23 are thus corrected through moving laser beam device 33 back and forth, left and right with reference to the respective reference positions calculated by control circuit 37. Display sections 22A and 23A are formed while the positions of operating units 22 and 23 are corrected.

As discussed above, switch unit 25A including the operating units with no display sections undergoes the measuring of the outer dimensions and calculating the reference positions, e.g. the center, with camera 32 and the shooting of laser beams with laser beam device 33. These processes allow forming display sections 21A-23A showing the marks such as "+", "−", "Λ""V" and "MODE" on the top faces of operating units 21-23, thereby completing switch 25.

To sum up, firstly mount the respective operating units into housing 4 for forming switch unit 25A, and next, measure the outer dimensions of each one of the operating units with camera 32 instructed by control circuit 37, at the same time, calculate the reference positions such as the center of the respective operating units. Then compare the dimensions with the reference dimensions stored in advance, and correct a positional deviation with a laser beam shot on the top faces of the operating units for forming the display sections.

Dispersions in the dimensions of the respective operating units or eccentricity or wobble of the operating units with respect to holes 4A of housing 4 can be thus controlled within 0.1 mm with respect to the reference dimensions. As a result, positional deviation of the display sections can hardly occur in manufacturing the switches.

Laser beam device 33 discussed above employs, in general, YAG laser, and shoots a laser beam with focal length of 150-250 mm and an output power of 7-8 W for forming the display sections with one shot of the laser beam. Use of a lower output power such as 5-6 W will require moving the laser beam device 33 two or three times for forming the display sections; however, it removes only non-translucent section 21C free from burning translucent section 21B placed beneath non-translucent section 21C.

The foregoing description touches the method of manufacturing switch 25 by using switch unit 25A placed on the top face of lower jig 30. A similar method can be applied to the method of manufacturing switch 26 by using switch unit 26A placed on the top face of lower jig 30, so that the description thereof is omitted here.

Figure 7:
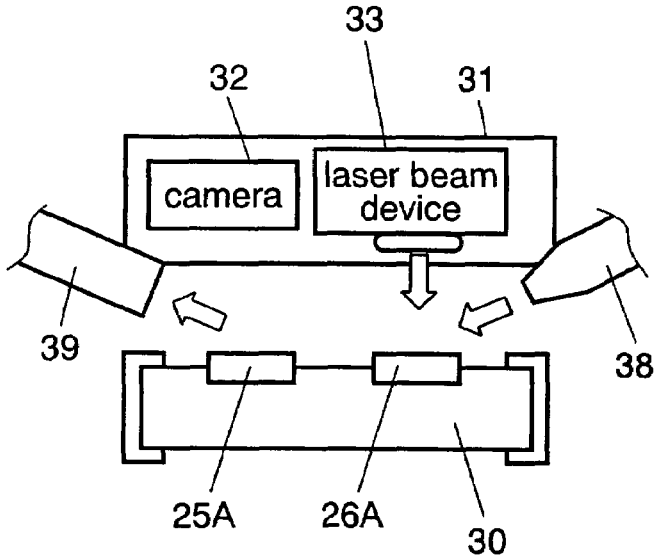
FIG. 7 shows another step of manufacturing the switch by the equipment shown in FIG. 5.

FIG. 7 shows another example of one of the steps done by the equipment to be used for manufacturing the switch. As shown in FIG. 7, discharging nozzle 38 and sucking nozzle 39 are placed between lower jig 30 and upper jig 31, and discharging nozzle 38 sprays cool air onto the top faces of switch units 25A and 26A, then sucking nozzle 39 sucks the air. The top faces undergo the shooting of a laser beam. This structure allows cooling the top faces irradiated with the laser beam and also resisting dust production, so that the switch can be manufactured more easily.

Figure 8:
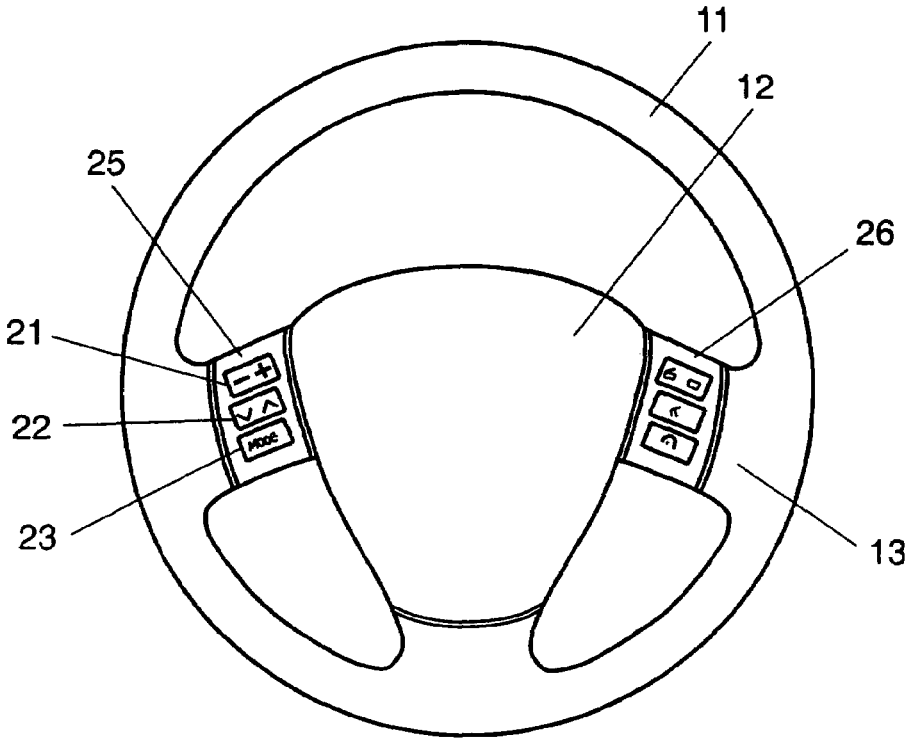
FIG. 8 shows a plan view of a steering wheel incorporating the switch.
Figure 9:
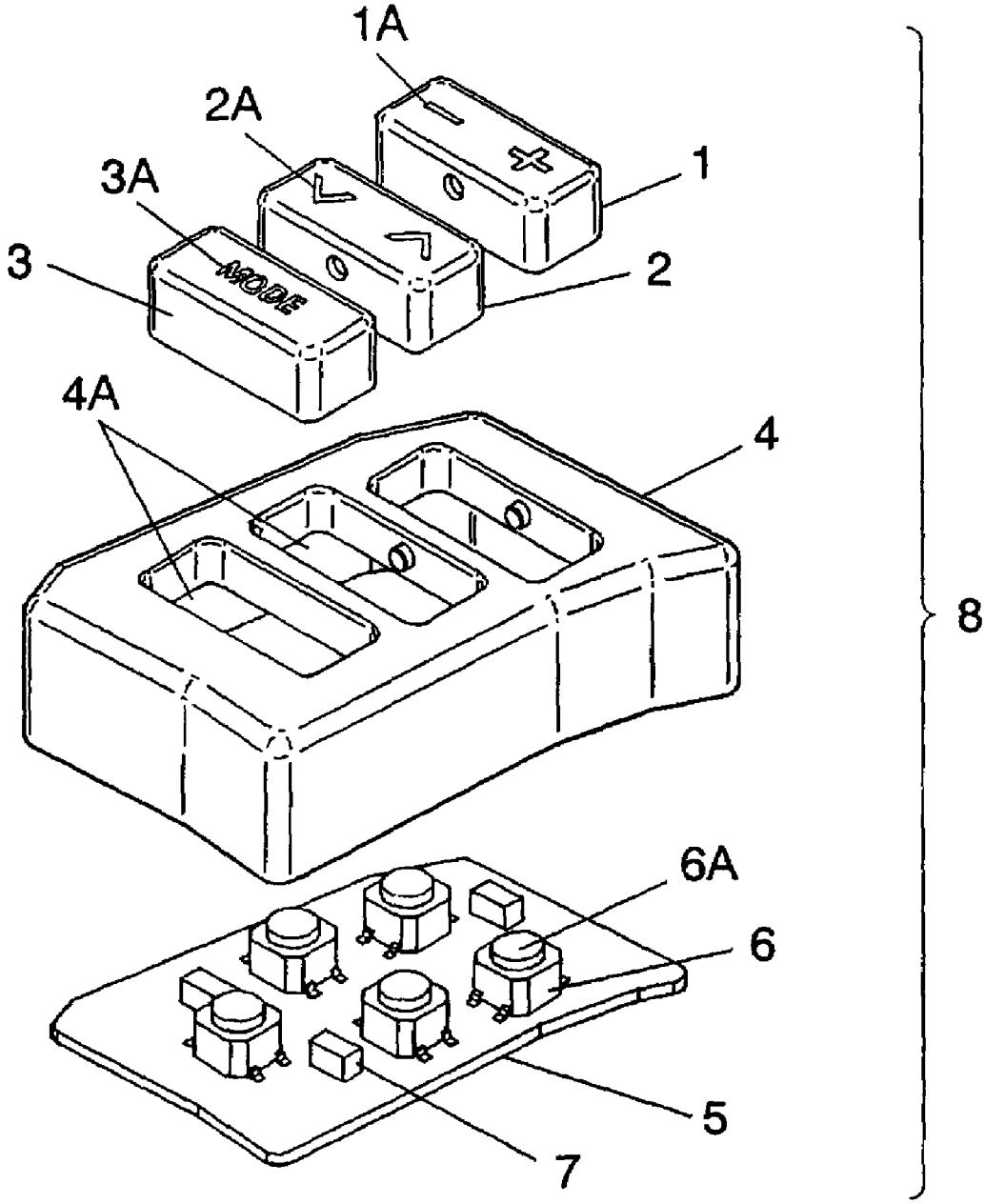
FIG. 9 shows an exploded perspective view of a conventional switch.
Figure 10A:
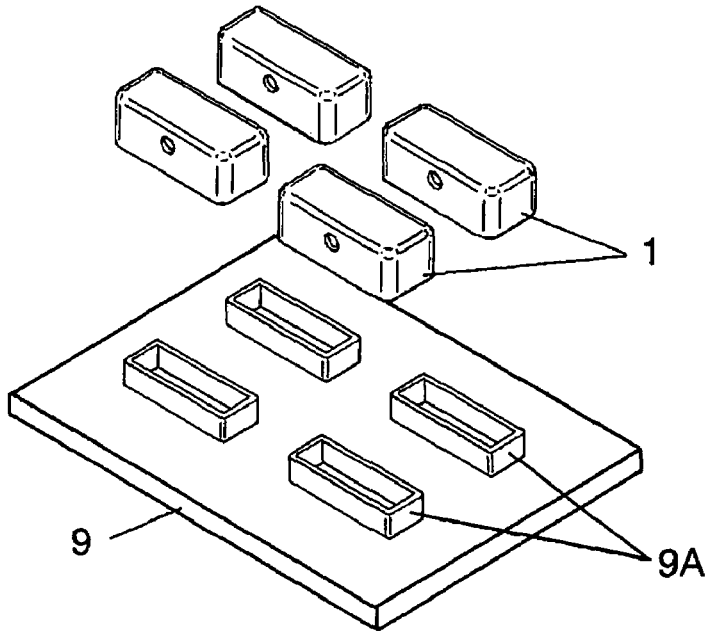
FIG. 10A shows a perspective view illustrating a first step of manufacturing the conventional switch.
Figure 10B:
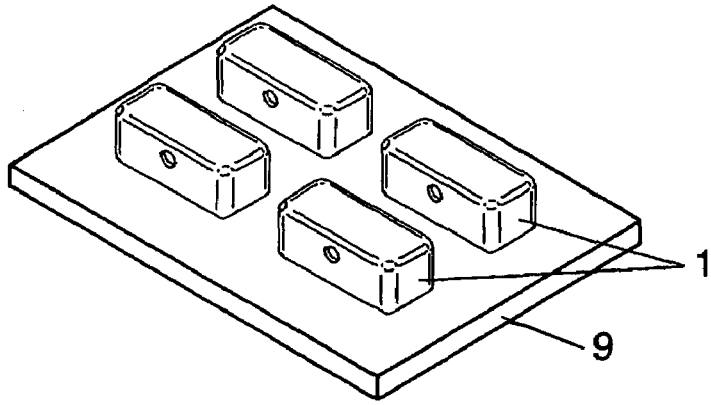
FIG. 10B shows a perspective view illustrating a second step of manufacturing the conventional switch.
Figure 10C:
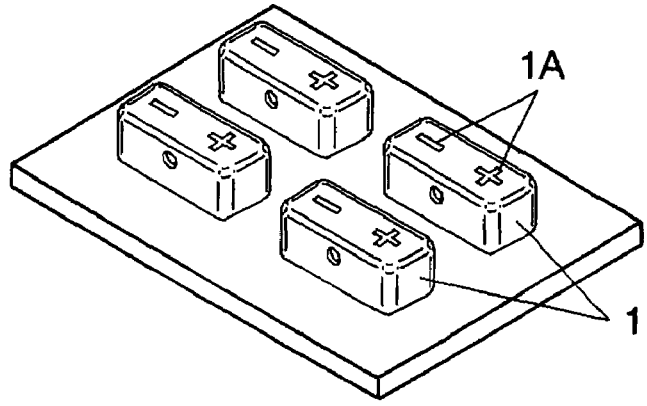
FIG. 10C shows a perspective view illustrating a third step of manufacturing the conventional switch.
Figure 11:
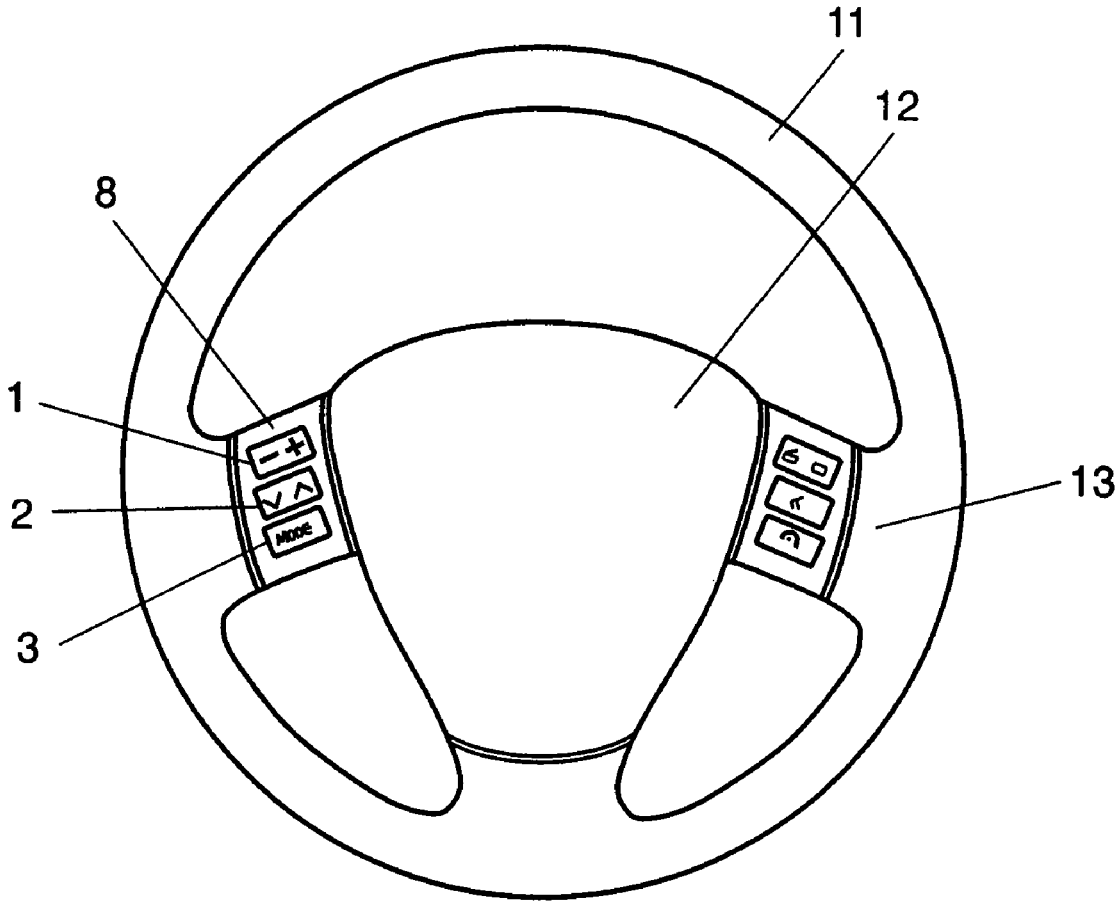
FIG. 11 shows a plan view of a steering wheel incorporating the conventional switch.

FIG. 8 shows a plan view of the steering wheel incorporating switches 25 and 26 thus manufactured. Switches 25 and 26 in pairs are mounted to steering wheel 11 at spokes 13 on both sides near to wheel 11. These spokes 13 are located between steering wheel 11 and pad 12 placed at the center and containing an airbag. The plurality of push switches 6 and light emitting elements 7 are coupled to electronic circuits of the automobile via the wired pattern of wired board 5, connectors, and lead wires (not shown), so that switches 25 and 26 are mounted to the automobile.

The foregoing structure allows the driver to depress, e.g., operating unit 21 on its right side where "+" is marked while the driver takes wheel 11 and extends his/her finger for depressing. Operating unit 21 then rocks on its center as a fulcrum, and depressing section 21D (refer to FIG. 1) on the underside at the right of operating unit 21 depresses shaft 6A for electrically switching on/off push switch 6 placed under operating unit 21.

The electronic circuits mounted to the automobile controls the devices in the automobile in response to electrical switch-on/off of push switch 6. For instance, the audio device mounted in the automobile increases its sound volume.

Rocking operation done to the left side, where "−" is marked, allows operating unit 21 to rock to the other side of "+", and push switch 6 placed under the left side of operating unit 1 is switched on/off, so that, e.g., the sound volume of the audio device decreases.

Rocking operation done to operating unit 22, where "∧""∨" are marked, allows controlling a temperature of an air conditioner installed in the automobile. Rocking operation to operating unit 23, where "MODE" is displayed, allows controlling switchover of a mode of a given device mounted in the automobile.

To sum up, switches 25, 26 mounted near steering wheel 11 allow the driver to maneuver operating units 21-23 by using, e.g., only his/her thumb for controlling the devices in the automobile while the driver keeps taking steering wheel 11. This structure thus allows the driver to operate the devices with ease while the driver sits at the wheel.

In the dark environment, e.g. in the night, operation of a given switch (not shown) prompts light emitting elements 7 to emit light. This light travels through translucent section 21B and illuminates, e.g. display section 21A of operating unit 21, so that the driver can identify the respective operating units with ease even in the dark environment.

As discussed above, the foregoing embodiment discloses the following method of manufacturing the switch: First, mount operating units 21-23 having no display sections to housing 4, then recognize the shapes and reference positions of the respective operating units with camera 32 instructed by control circuit 37. At the same time, move upper and lower jigs 31 and 30 for laser beam device 33 to remove non-translucent section 21C, thereby exposing translucent section 21B so that display sections 21A-23A are formed. The display sections are thus formed on the respective operating units with the switch assembled, so that no positional deviation occurs and no visual check for confirming the display sections in assembling is required. As a result, the switch easy to manufacture can be obtained, and the method of manufacturing the same switch is obtainable.

Moving upper and lower jigs 31 and 30 back and forth, left and right, or up and down, or slanting upper and lower jigs 31 and 30 allows forming a plurality of display sections in series even if a plurality of operating units having various types of displays as discussed above are arranged. This method can thus manufacture the switches having little positional deviation within a rather short time.

In the foregoing description, push switch 6 is used as a switch contact; however, a variety of switch contacts can be used, for instance, a domed movable contact made of conductive metal can be used. Another switch contact formed of a movable contact and a fixed contact confronting each other between an upper flexible film and a lower flexible film can be also used.

In the foregoing description, both of upper jig 31 and lower jig 30 are moved or slanted; however, either one of jigs 30 or 31 can be moved or slanted although this structure takes a time for manufacturing.

The switch and the manufacturing method of this switch of the present invention are useful for the switches for controlling a variety of electronic devices installed in automobiles, because the switch resists producing positional deviations in the display sections, and are easy to manufacture.

What is claimed is:

1. A method of manufacturing a switch comprising the steps of:

(a) forming a switch unit by mounting an operating unit to a housing, which operating unit includes a non-translucent section covering a surface of a translucent section;

(b) disposing the switch unit on a lower jig for a control circuit to recognize a shape of the operating unit with a camera mounted to an upper jig disposed over the lower jig; and (c) forming a display section on the operating unit mounted in said housing with a laser beam device mounted to the upper jig by controlling said laser beam device with said control unit.

2. The manufacturing method of claim 1, wherein step (b) includes the step of controlling a driving device with the control circuit for at least one of the lower jig and the upper jig to move back and forth, left and right, up and down, or to slant.

3. The manufacturing method of claim 1, where step (c) includes the step of spraying air onto the top faces of said switch units with a discharging nozzle and sucking the air with a sucking nozzle.

4. The manufacturing method of claim 1, wherein step (b) includes the step of calculating a reference position of the operating unit utilizing the dimensions of the operating unit; and step (c) includes the step of controlling the laser beam device by comparing said reference position with the reference position calculated by reference dimensions of the operating unit, which have been stored in advance, and correcting through moving the upper jig with said control unit. z,21 z,22 z,21 z,22 z,21 z,22 z,21 z,22 z,21 z,22

* * * * *